United States Patent [19]

Box

[11] Patent Number: 4,775,050

[45] Date of Patent: Oct. 4, 1988

[54] BEVERAGE CASE

[75] Inventor: Thomas Box, Tinton Falls, N.J.

[73] Assignee: Spectrum International, Inc., Shrewsbury, N.J.

[21] Appl. No.: 47,409

[22] Filed: May 6, 1987

[51] Int. Cl.[4] ..... B65D 21/04; B65D 1/44

[52] U.S. Cl. ..... 206/507; 206/429; 206/511; 220/72

[58] Field of Search ..... 206/505, 507, 509, 511, 206/512, 429; 220/72

[56] References Cited

U.S. PATENT DOCUMENTS

| | | | |
|---|---|---|---|
| D242,600 | 12/1976 | Box . | |
| D245,760 | 9/1977 | Box . | |
| D258,803 | 4/1981 | Box . | |
| D259,294 | 5/1981 | Box . | |
| D261,194 | 10/1981 | Box . | |
| D265,009 | 6/1982 | Box . | |
| D266,709 | 10/1982 | Box . | |
| 3,361,293 | 1/1968 | Box . | |
| 3,392,875 | 7/1968 | Bockenstette | 206/507 |
| 3,425,594 | 2/1969 | Bridenstine | 206/507 |
| 3,568,879 | 3/1971 | Box . | |
| 3,655,088 | 4/1972 | Box . | |
| 3,659,743 | 5/1972 | Box . | |
| 3,675,815 | 7/1972 | Rehrig | 206/507 |
| 3,682,351 | 8/1972 | De Putter | 206/505 |
| 3,997,055 | 12/1976 | Box . | |
| 3,998,327 | 12/1976 | Box . | |
| 3,998,328 | 12/1976 | Box . | |
| 4,190,172 | 2/1980 | Box | 206/505 |
| 4,441,615 | 4/1984 | Goodrich | 206/512 |
| 4,478,156 | 10/1984 | Andersson | 206/511 |
| 4,548,320 | 10/1985 | Box . | |

FOREIGN PATENT DOCUMENTS

| | | | |
|---|---|---|---|
| 2805880 | 2/1979 | Fed. Rep. of Germany | 206/507 |
| 1512202 | 1/1968 | France | 206/509 |

OTHER PUBLICATIONS

Photograph of a Swedish beverage carton crate upside down on a conveyer.

*Primary Examiner*—George E. Lowrance

*Attorney, Agent, or Firm*—Hedman, Gibson, Costigan & Hoare

[57] ABSTRACT

A stackable and nestable beverage case is provided. A rib structure to afford rigidity and durability, tapered sides to facilitate removal of containers from the case and tapered surfaces to provide secure nesting of cases are provided.

10 Claims, 6 Drawing Sheets

BEVERAGE CASE

FIELD OF THE INVENTION

This invention relates to beverage cases for transporting and storing a plurality of cartons or bottles. More particularly, the present invention relates to plastic molded beverage cases adapted to be stacked or nested and capable of withstanding the heavy forces imposed in transporting the cases.

BACKGROUND OF THE INVENTION

Cases for transporting and storing beverage cartons and bottles have long been known. Wooden and metal cases have been used to accommodate beverage cartons and bottles for many years. More recently, plastic molded rectangular beverage cases have been developed and are now widely used. Typically, the plastic beverage case is injection molded of polypropylene, polyethylene or a similar long chain cross-linked polyolefin. The beverage cases are required to be sufficiently structurally sound to withstand repeated use in both the full, partially full and empty condition. As a result, the molded plastic beverage cases are customarily provided with four full sides that extend from the bottom to the top of the case.

The service to which the beverage cases is put includes edge to edge stacking in both the full and empty condition to form columns three high, four high or higher. In addition, recent efforts have developed rectangular plastic molded beverage cases which can both be stacked and nested. The design requires that the longitudinal side of the beverage case be partially open. The stacking feature is directed principally for the full or loaded condition and nesting is used principally for storing and transporting cases in the empty condition. Stacking occurs by arranging the beverage case with the bottom edge of a beverage case on the upper edge of the beverage case directly below. Nesting occurs by placing the beverage cases alternatively transverse to each other.

There now also exist beverage cases having legs to elevate the carton or bottle support surface above floor level with the two shorter or lateral sides of the four rectangular sides extending above the two longer or longitudinal sides. The legs are provided to allow transport means to reach under the support surface to lift the beverage case. The extended lateral sides provide the surface edges on which the legs rest when the beverage cases are in the stacked condition. The two longitudinal sides adjacent the elevated sides provide access to the cartons resting on the support surface and facilitate nesting by presenting a depression into which a beverage case can fit when arranged transversely with another beverage case.

SUMMARY OF THE INVENTION

It is an object of the present invention to provide a durable beverage case capable of being stacked or nested.

A further object of the invention is directed to providing a beverage case with means to facilitate nesting.

Thus, a rectangular beverage case is provided with legs to elevate the support surface for the cartons above floor level. Longitudinal sides extend upwardly an intermediate distance from the carton support surface with the lateral sides extending well above the top of the longitudinal sides. This design provides a structure wherein fully loaded beverage cases can be stacked with the legs of the beverage case resting on the upper surface of the lateral sides of the beverage case below. Alternatively, empty beverage cases can be nested by mounting the alternative beverage cases transversely to each other in the depression formed by the low longitudinal sides.

With the absence of four fully extended sides the beverage case is provided with a rib arrangement or matrix that affords the rigidity and strength necessary for heavy duty handling of beverage cases. Vertical diagonal ribs extend outwardly from each of the four corners of the beverage case; two horizontal parallel continuous ribs extend outwardly from the beverage case, the upper continuous rib aligned with the carton support surface. A panel is formed between the upper and lower continuous ribs on each longitudinal side to provide a surface below the carton support surface against which a conventional hook can bear for moving the beverage case across a floor.

The longitudinal sides are formed with upper edges that are at an angle extending upwardly and outwardly from inside to outside to facilitate removal of the cartons from stacked beverage cases. In addition, at the four locations at which the longitudinal sides meet the lateral sides, tapered sections are provided to enable positive nesting of the beverage cases.

The support surface for the cartons or bottles is formed with holes except for the surface adjacent each of the sides. The holes afford drainage and reduce the weight of the case. The solid surface adjacent the longitudinal sides prevents the handling hook from gaining access to the cartons or bottles on the support surface.

DESCRIPTION OF THE DRAWINGS

The invention will be better understood when considered with the following drawings wherein.

DESCRIPTION OF THE PREFERRED EMBODIMENT

Figure 1:
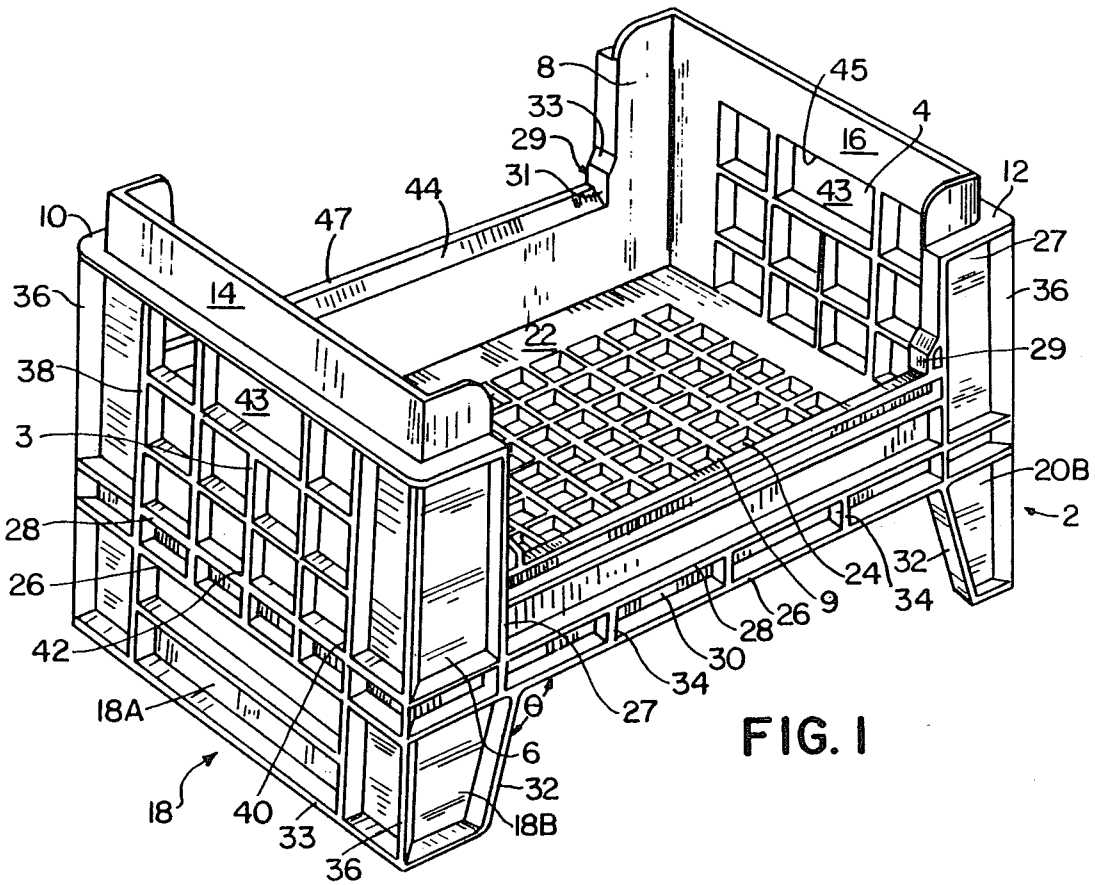
FIG. 1 is a perspective view of the beverage case of the present invention.
Figure 3:
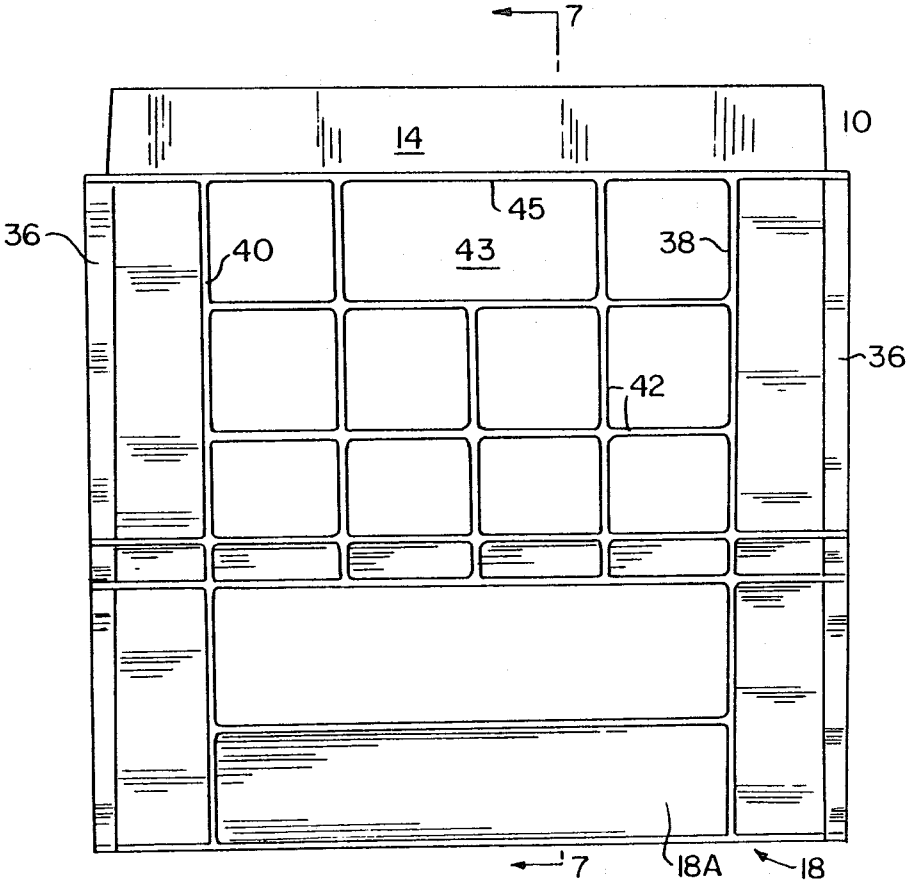
FIG. 3 is a side elevational view of a lateral side of the beverage case of FIG. 1.

The present invention is embodied in the plastic molded rectangular beverage case 2 shown in perspective in FIG. 1. The rectangular beverage case 2 is provided with lateral sides 3 and 4, longitudinal sides 6 and 8 and a carton surface 9. Lateral sides 3 and 4 extend upwardly above the longitudinal sides 6 and 8 and terminate in surfaces 10 and 12 respectively on which a beverage case 2 can be stacked. A collar 14, 16 extends upwardly from the inner edge of the respective surfaces 10 and 12 of the lateral sides 3 and 4, as seen in FIGS. 1 and 3.

Figure 5:
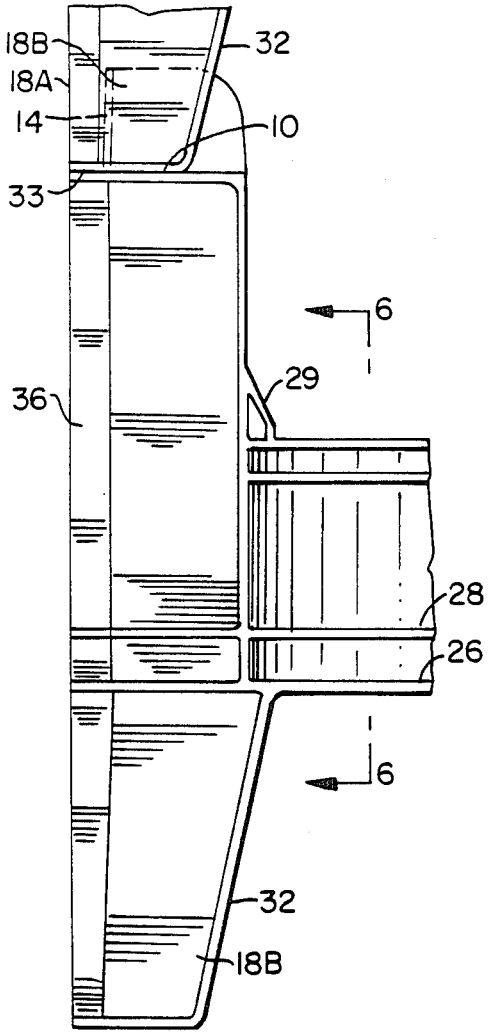
FIG. 5 is a partial sectional elevational view of the beverage case of FIG. 1 showing the legs of a second beverage case fitting in the stacking arrangement.

The beverage case is also provided with legs 18 and 20 which are comprised of full lateral sections 18A, 20A and short longitudinal leg sections 18B, 20B. The lateral leg sections 18A and 20A are in the same vertical plane as the lateral sides 3 and 4 and, in effect, are continuations of the lateral sides 3 and 4. The longitudinal leg sections 18A and 20A seen in FIGS. 1 and 5, are relatively short and define an opening below the bottom of the surface 9 into which lifting devices or hooks may access below the case surface 9.

The longitudinal leg sections 18B and 20B are sized to define the opening between the oppositely facing longitudinal leg sections 18B and 20B on the same longitudinal side a length equal to the length of a lateral side 3 or 4 of the beverage case 2 to thereby facilitate nesting of beverage cases 2. The longitudinal leg sections 18B and 20B are formed at an angle whereby the bottom of the section 18B, 20B is shorter than the top. The preferred angle $\theta$, seen in FIG. 1, is 75° to 80°; i.e. 77°.

Figure 4:
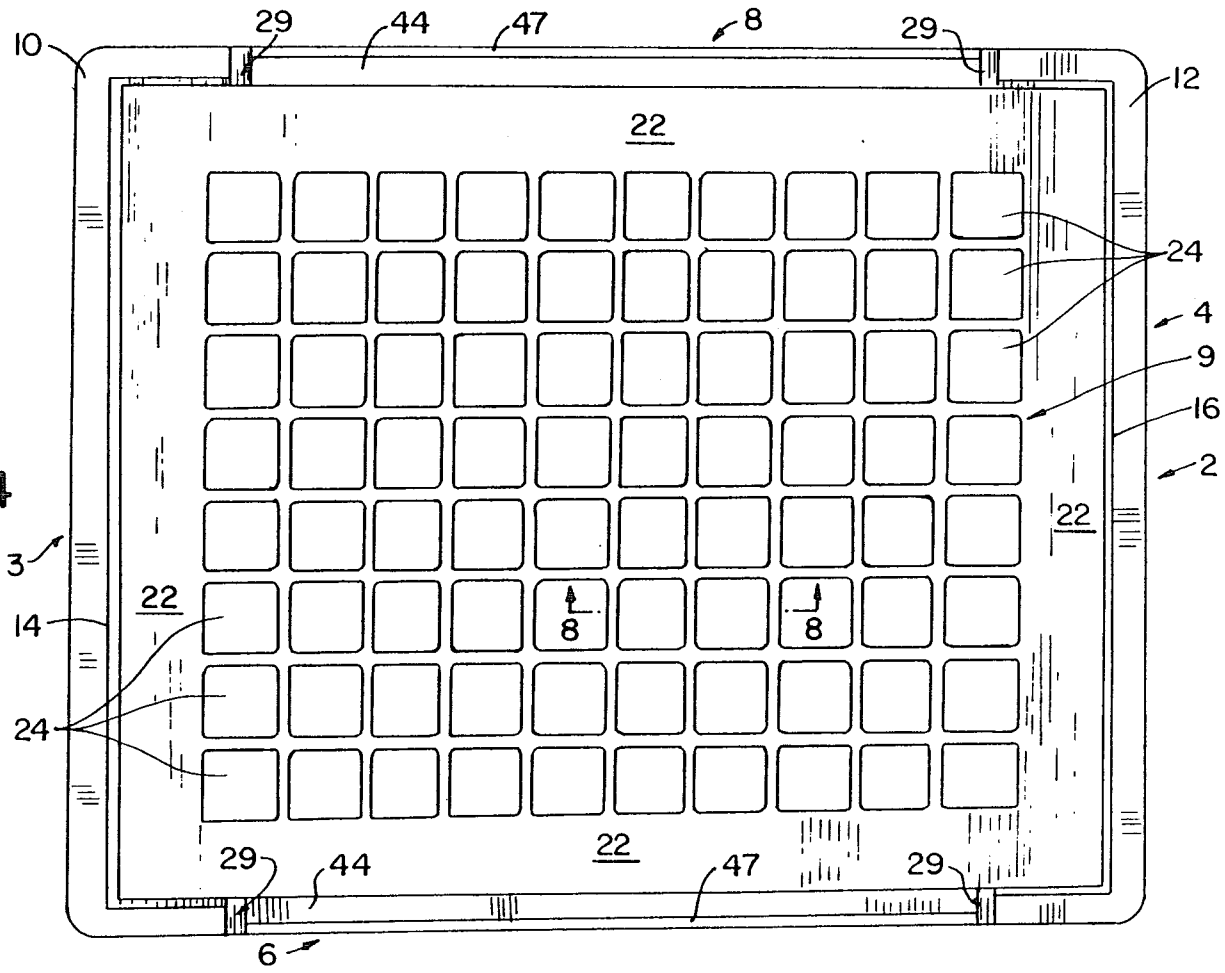
FIG. 4 is a plan view of the beverage case of FIG. 1.
Figure 8:
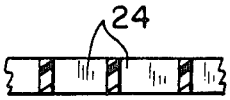
FIG. 8 is a sectional view through line 8—8 of FIG. 4.

The case surface 9, as best seen in FIGS. 4 and 8, is comprised essentially of a solid continuous rectangular perimeter 22 and a plurality of holes 24. The perimeter 22 serves to prevent a conventional hook used to grip and pull the case 2, from reaching a carton resting on the surface 9. The holes 24 serve to allow liquid to drain from the case surface 9 and to minimize the weight of the case 2.

Figure 2:
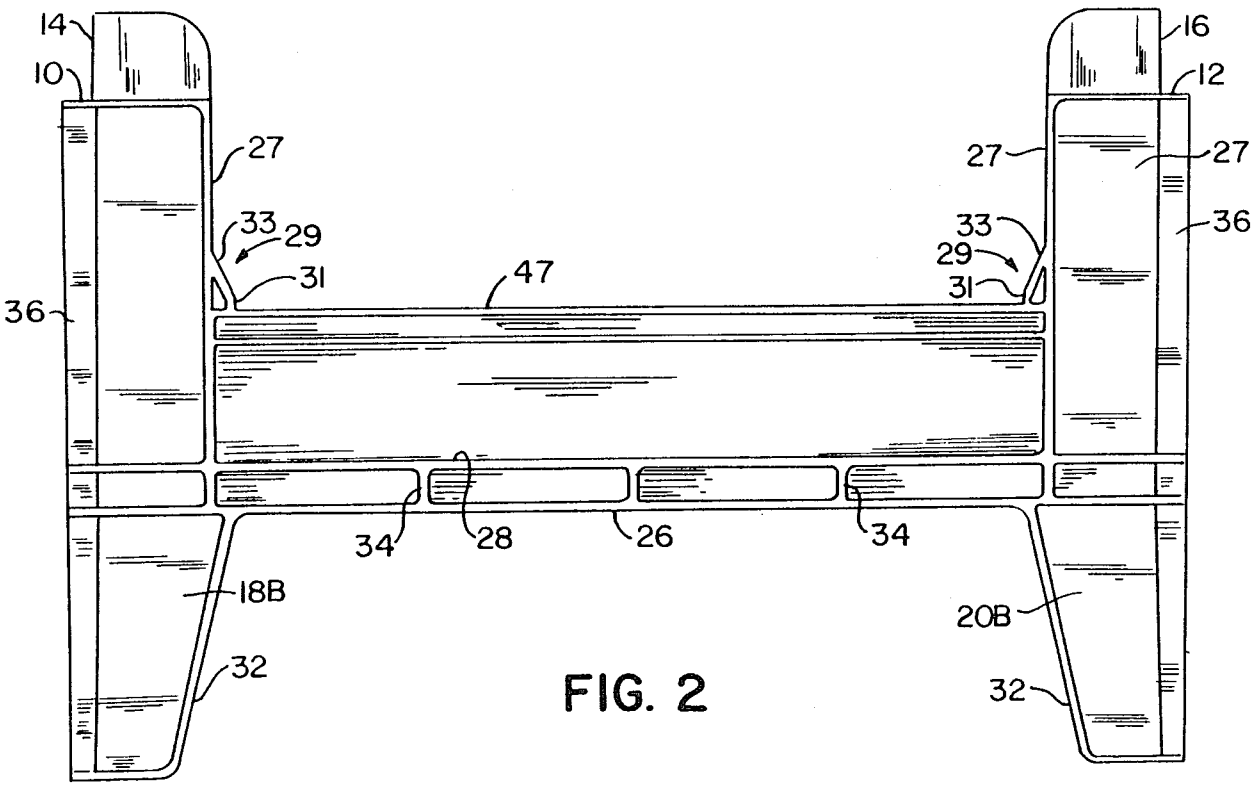
FIG. 2 is a side case elevational view of a longitudinal side of the beverage of FIG. 1.
Figure 6:
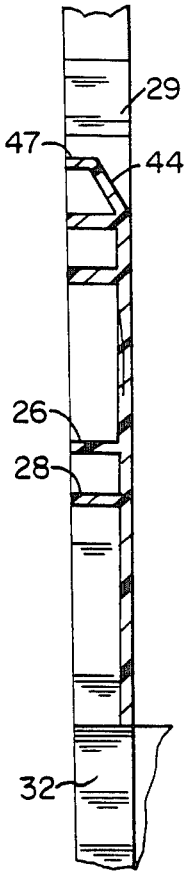
FIG. 6 is a sectional elevational view through line 6—6 of FIG. 5.
Figure 7:
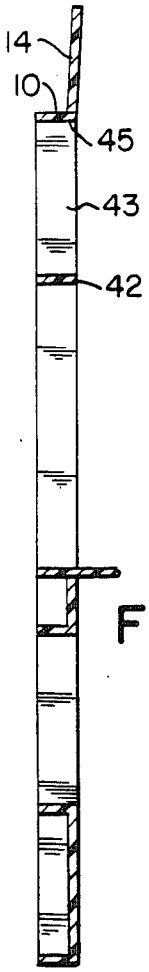
FIG. 7 is a sectional view through line 7—7 of FIG. 3.

As best seen in FIGS. 1, 2 and 6, a horizontal rib 26 and a horizontal rib 28 extend around the case 2 to form parallel continuous ribs. A solid panel section 30 extends between the rib 26 to the rib 28 on the longitudinal sides 6 and 8 of the beverage case 2. A rib 32 extends from the rib 26 along the entire edge of each of the longitudinal leg sections 18B and 20B. Further, a rib or horizontal edge surface 33 extends across the bottom edge of the lateral sides 3 and 4. Vertical reinforcing ribs 34 extend between the parallel horizontal ribs 26 and 28. Each corner of the case 2 is also provided with a vertical rib 36 extending on a diagonal from the case 2. Further, as shown in FIGS. 1, 3 and 7, each lateral side 3 and 4 is provided with two intermediate vertical reinforcing ribs 38 and 40 and a rib matrix 42 between the intermediate vertical ribs 38 and 40. Handle sections 43 are also provided in lateral sides 3 and 4 to enable manual lifting of the beverage case 2. The upper edge 45 of the handle sections 43 is preferably rounded.

The longitudinal sides 6 and 8 are provided with vertical edge ribs 27 that extend from the surfaces 10 and 12 to the horizontal continuous rib 28. In addition, the upper edge 47 of each longitudinal side 6 and 8 is provided with a taper 44 that extends upwardly from the inside to the outside of the beverage case 2 and facilitates removal of the cartons or bottles when the cases 2 are loaded and stacked. The preferable angle of the taper 44 is thirty degrees.

Figure 9:
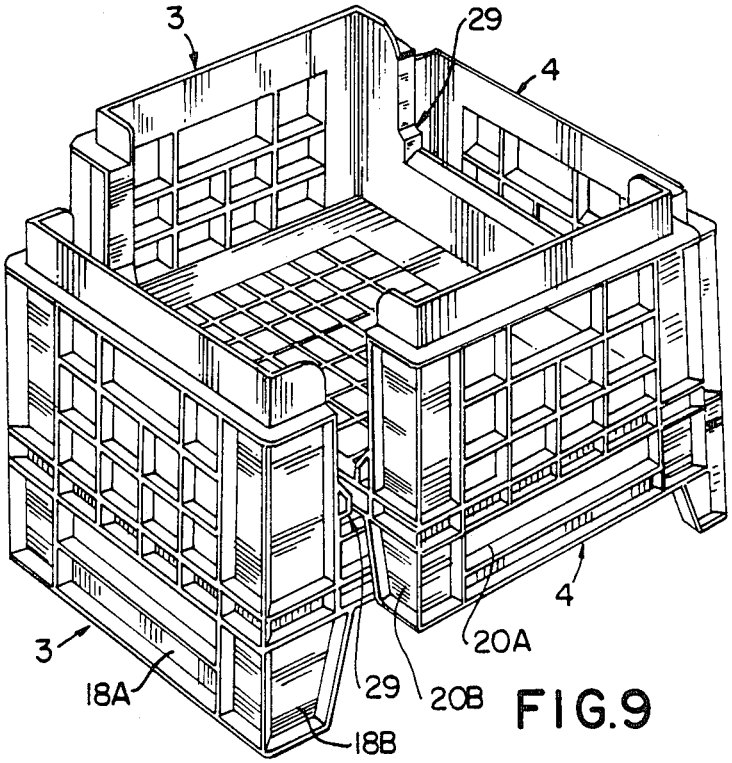
FIG. 9 is a view of two beverage case in the nested mode.

A tapered guide member 29, best seen in FIGS. 1 and 2, is formed at the upper edge 47 where the longitudinal sides 6 and 8 meet the lateral edge ribs 27. The tapered guide members 29 are provided with short vertical sections 31 and upper tapered sections 33 to afford positive guidance during nesting of the beverage cases 2. As shown in FIG. 9, the distance between the oppositely facing vertical sections 31 is essentially the same as the width of the lateral side of the beverage cases 2. Thus, a sliding centering effect is created with a resultant firm holding condition for cases when in the nested mode.

In the stacked mode, the beverage cases 2 form a column in which the four sides of each case 2 of the column are in the same plane. As seen in FIG. 5, the surface 33 of a leg 18 sets directly on the upper edge 10 of the lateral side 3.

The arrangement of ribs in combination with the location of the surface 9 provides a durable case structure that protects against deflection and deformation of the case 2. In practice, it has been found that the case 2 can be stacked six high with all six cases 2 fully loaded with cartons or bottles without any damage to the cases or cartons within the cases when forces are imposed on the column of cases to effect movement.

In effect a U-frame structure is formed by the ribs 32 and the portion of rib 26 between the ribs 32. This U-frame structure is below the beverage case support surface 9 and provides enhanced floor to wall strength, rigidity when stressed diagonally and better carton carrying characteristics due to limited flexibility of the bottom of the case and rigidity of the outside structure. Combined with the outside rib structure which includes vertical edge ribs 36 and the continuous horizontal ribs 26 and 28, the U-frame provides a solid structure for the beverage case.

The solid panel section 30 is also below the support surface 9 and serves as a bearing surface against which a hook (not shown) can bear to pull a beverage case 2 or a column of beverage cases 2 horizontally across a floor surface. The horizontal rib 28, which is in the same horizontal plane as the support surface 9, horizontal rib 26 and the vertical ribs 34 provide a structure capable of reacting the force of the hook without damage to the beverage case 2 or the cartons within the beverage case 2.

Although the invention has been described as storing and transporting beverage cartons and bottles, it is clear that many various articles can be stored or transported by the beverage case. Therefore, the term containers, when used, is used in the broad sense to mean cartons, bottles and other items.

I claim:

1. A rectangular beverage case having two longitudinal sides and two lateral sides that extend upwardly above the longitudinal sides; legs extending downwardly from the lateral sides and a container support surface comprising:

an exterior rib structure for imparting structural rigidity to beverage cases comprised of a first continuous horizontal rib at the elevation of the container support surface, a second continuous horizontal rib spaced apart from and below the first continuous horizontal rib; a vertical rib extending from the entire edge of each of the four edges of the beverage case; a solid panel between the first and second horizontal ribs along both longitudinal sides of the beverage case; parallel vertical ribs at intermediate locations on each lateral side; a matrix of ribs with openings between the ribs on each lateral side of the beverage case and an opening in each of the lateral sides for gripping the beverage case; and a horizontal support surface at the top of each lateral side; four ribs each extending along the vertical edge of each longitudinal side form the horizontal rib and a vertical collar on the inner edge of each horizontal support surface at the top of each lateral side.

2. A rectangular beverage case as in claim 1 further comprising upper edge tapered upwardly and outwardly on each longitudinal side.

3. A rectangular beverage case as in claim 1 further comprising means for guiding a case into the nested mode and firmly holding the case when in the nested mode.

4. A rectangular beverage case as in claim 1 further comprising solid vertical sections extending along the longitudinal sides below the container support surface agains which a conventional hook can be applied.

5. A rectangular beverage case as in claim 4 further comprising a continuous peripheral section formed around the container support surface and holes in the container support surface.

6. A rectangular beverage case as in claim 1 having legs comprised of lateral sections extending the entire length of the lateral side and longitudinal section extending only a short distance longitudinally to define a longitudinal opening essentially equal to the size of a lateral side.

7. A rectangular beverage case as in claim 2 wherein the tapered edge is thirty degrees.

8. A rectangular beverage case as in claim 3 wherein the means for guiding a case into the nested mode and firmly holding the case in the nested mode is comprised of four sections having tapered upper surfaces and flat vertical lower surfaces, the four sections each located respectively at the location at which the lateral and longitudinal sides meet.

9. A rectangular beverage case as in claim 8 further comprising longitudinal leg section that are formed at an angle to the vertical whereby the horizontal length dimension of the top of the longitudinal leg section is greater than the horizontal length dimension at the bottom of the longitudinal leg section.

10. A rectangular beverage case as in claim 9 wherein the angle to the vertical that the longitudinal leg section makes is 75° to 80°.

* * * * *